US008020357B2

(12) United States Patent
Haschke

(10) Patent No.: US 8,020,357 B2
(45) Date of Patent: Sep. 20, 2011

(54) CLIP CLOSURE SYSTEM

(75) Inventor: Eggo Haschke, Deerfield, IL (US)

(73) Assignee: Poly-Clip System Corp., Mundelein, IL (US)

( * ) Notice: Subject to any disclaimer, the term of this patent is extended or adjusted under 35 U.S.C. 154(b) by 0 days.

(21) Appl. No.: 11/424,251

(22) Filed: Jun. 15, 2006

(65) Prior Publication Data

US 2006/0283144 A1 Dec. 21, 2006

Related U.S. Application Data

(60) Provisional application No. 60/690,961, filed on Jun. 16, 2005.

(51) Int. Cl.
*B65B 51/04* (2006.01)

(52) U.S. Cl. ..... 53/138.4; 53/138.2; 140/93 D

(58) Field of Classification Search ..... 53/138.2–138.4, 53/416–417, 139.1, 583, 305; 227/23, 120, 227/155; 29/798, 243.56; 72/453.16, 409.12, 72/410, 412–416, 409.01; 140/57, 105, 106, 140/113, 93 D, 93 A See application file for complete search history.

(56) References Cited

U.S. PATENT DOCUMENTS

| | | | | | |
|---|---|---|---|---|---|
| 2,267,185 | A * | 12/1941 | Bauwens | 227/77 |
| 2,391,891 | A * | 1/1946 | Frankel | 29/33.52 |
| 2,396,562 | A * | 3/1946 | Forss | 72/407 |
| 2,449,865 | A * | 9/1948 | Tanguay et al. | 29/33.52 |
| 2,453,872 | A * | 11/1948 | Stauffer | 72/409.04 |
| 2,455,557 | A * | 12/1948 | Burner | 29/816 |
| 2,692,384 | A * | 10/1954 | Pollock | 72/407 |
| 2,942,269 | A * | 6/1960 | Anstin | 72/306 |
| 3,068,485 | A * | 12/1962 | Lingle et al. | 72/407 |
| 3,293,736 | A * | 12/1966 | Tipper | 29/243.57 |
| 3,503,119 | A * | 3/1970 | Seitz, Jr. et al. | 29/509 |
| 3,810,495 | A * | 5/1974 | Pack | 140/93 A |
| 3,945,238 | A * | 3/1976 | Eckert | 72/409.03 |
| 4,002,007 | A * | 1/1977 | Bertelsen | 53/138.4 |
| 4,125,136 | A * | 11/1978 | Olcese et al. | 140/105 |
| 4,218,861 | A * | 8/1980 | Marz | 53/138.4 |
| 4,517,737 | A * | 5/1985 | Sulzle | 29/798 |
| 4,798,231 | A * | 1/1989 | Glaus et al. | 140/119 |
| 5,000,233 | A * | 3/1991 | Oetiker | 140/150 |
| 5,020,355 | A * | 6/1991 | Payne et al. | 72/407 |
| 5,035,040 | A * | 7/1991 | Kerrigan et al. | 29/505 |
| 5,040,400 | A * | 8/1991 | Nastasi | 72/325 |
| 5,305,628 | A * | 4/1994 | Cluggish | 72/409.04 |
| 5,771,664 | A * | 6/1998 | Recchia, Jr. | 53/417 |
| 6,205,747 | B1 * | 3/2001 | Paniagua Olaechea | 53/417 |
| 6,327,945 | B1 * | 12/2001 | Perez Romo | 81/426 |
| 6,401,306 | B1 | 6/2002 | Hanten et al. | |
| 6,883,297 | B2 | 4/2005 | Kirk et al. | |
| 6,895,726 | B2 | 5/2005 | Pinto et al. | |
| 2007/0033904 | A1 * | 2/2007 | Wilkins et al. | 53/138.4 |

* cited by examiner

*Primary Examiner* — Lindsay Low
(74) *Attorney, Agent, or Firm* — Clark Hill PLC

(57) ABSTRACT

A clip closure system for closing clips, each clip having a base section and first and second legs extending from opposite ends thereof, is described. The clip closure system has a rail configured to hold the clips; first and second jaws which are rotatably connected to the rail; a connector; first and second arms, the first arm being connected to the first jaw and to the connector, the second arm being connected to the second jaw and to the connector; an actuator configured to move the connector such that the first jaw rotates relative to the rail to contact and bend the first leg of the clip toward the base section of the clip, and such that the second jaw rotates relative to the rail to contact and bend the second leg of the clip toward the base section of the clip.

8 Claims, 3 Drawing Sheets

CLIP CLOSURE SYSTEM

PRIORITY AND INCORPORATION BY REFERENCE

This application claims the benefit of priority of U.S. Provisional Patent Application No. 60/690,961, filed on Jun. 16, 2005, which provisional application is hereby incorporated by reference in its entirety.

BACKGROUND OF THE INVENTION

This invention relates generally to the field of closing bags, netting, or casings. This invention relates more specifically to applying a clip to a gathered neck of a bag, a net, or a casing. This invention also relates to attaching a label while applying a clip to a gathered neck of a bag, a net, or a casing. More particularly, the invention relates to the field of packaging edible food products, such as hams, poultry, sausages, and cheeses, in bags, netting, or casings. The invention can be used for closing any materials in a bag, netting, or casing, and is not limited to edible food products.

Many food products are packaged in another material, either for processing or for final sale. Sausages, for example, are made by mixing minced meat and seasonings to produce a pasty product, which is extruded through a product horn into a tubular casing. A clipper creates a void in the extruded tubular casing, gathers the casing into a neck, applies two clips to the neck, and severs the casing between the two clips, to form the back end of a completed sausage and the front end of the sausage still being extruded. Other food products, including hams, turkeys, and whole-muscle products, are produced in a similar fashion.

Some food products are packaged in bags, which must then be closed. Poultry, for example, including in particular whole chickens and chicken parts, are often packaged in clear plastic bags. After the poultry has been inserted into a bag, a clipper gathers the open end of the bag, gathers it into a neck, and applies a clip to close the bag.

Other food products are encased in netting for sale to the final consumer. Larger items such as hams, turkeys, turkey breasts, sausages, and cheeses, are packaged in netting for ease of handling. Typically, one end of tubular netting is closed with a clip, the item is placed within the netting, the netting is gathered tightly around the item, a clip is applied to enclose the item within the netting, and the netting is severed. Often, a loop is formed in one end of the netting to create a handle on the package, to ease handling of the items, which may be heavy, and to allow consumers to lift the items without actually touching the items. Sometimes a label is attached to one of the clips to provide identifying information.

In some situations, items are packaged in netting in order to enhance the appearance of the items after processing. For example, sausages, hams, and cheeses are often encased in tubular netting, as described above, prior to processing. During processing, such as in a smokehouse, the item expands within the netting and pushes through the mesh of the netting. After processing, the netting is removed and discarded. The item retains a dimpled appearance that is considered pleasing to consumers.

In most situations described above, as well as in other situations, the bag, casing, or netting must be closed securely. If a consumer picked up a large item such as a turkey and the netting slipped, an injury could result, either from the turkey falling out one end of the netting or by the handle pulling tightly about the consumer's fingers. During smoking of hams or sausages, if the netting did not hold tight about the item, the item would not expand through the mesh of the net and would not obtain the dimpled appearance that is considered desirable. If a bag of chicken was not sealed tightly, liquids within the bag could leak out, creating not only an appearance unsightly to consumers but also a health hazard.

Clips are generally used to seal packages in the situations described above, as well as in many other situations. (The common office staple, for example, that holds pieces of paper together, is a clip.) An exemplary clip as is known in the prior art is described in U.S. Pat. No. 6,401,306, Sealing Clips For Bags And Tubes And Matrix For Sealing The Latter.

A conventional prior-art clip 10 is shown in FIG. 1. Clip 10 has a top section 12 from which project two identical legs 14, defining a space 16 between the legs 14. Legs 14 are often pointed, to ease entry into the grooves of a die or to punch through material. A series of clips are usually assembled into a cartridge, held together by glue or tape, which is loaded into a clipper. The cartridge of clips is often carried on a rail to the operating point of the clipper.

Clips are closed by a combination of a punch and a die. The clipper orients the first clip 10 from a cartridge over a neck of a gathered bag, casing, or netting, so that the neck is within the space 16. A punch presses on the top section 12 of the clip, forcing the legs 14 into grooves on a die. The grooves force the legs 14 inward toward each other as the punch descends, until the legs have closed to form an aperture surrounding the neck of gathered bag, casing, or netting.

The punch-and-die system of the prior art requires quite a bit of power to operate, as a great deal of pressure is required to close a clip by punching the top of it. Additionally, precise control of the amount of punching power is required. Enough punch power must be applied to seal the clip, especially for food products, which must be thoroughly sealed. Too much punch, however, will destroy the bag, casing, or netting, contrary to the intended purpose of the system. Achieving the proper power for the punch is a problem for clipper manufacturers.

Additionally, precise alignment is required, in order for the legs 14 of the clip to enter into the grooves of the die. If the alignment is off by even a small amount, the legs 14 will not enter the grooves and will not be bent inward in the proper manner to seal the package. The need for precise alignment produces high maintenance and operating costs.

Moreover, a punch-and-die system is relatively slow.

Accordingly, needs exist for a clip closure system that uses less power, requires less precise alignment, and operates faster than the system of the prior art. The present invention meets these needs.

BRIEF SUMMARY OF THE INVENTION

Briefly, and in accordance with the foregoing, the present invention discloses a clip closure system for closing clips, each clip having a base section and first and second legs extending from opposite ends thereof. In a first embodiment, the clip closure system has a rail configured to hold the clips; first and second jaws which are rotatably connected to the rail; a connector; first and second arms, the first arm being connected to the first jaw and to the connector, the second arm being connected to the second jaw and to the connector; an actuator configured to move the connector such that the first jaw rotates relative to the rail to contact and bend the first leg of the clip toward the base section of the clip, and such that the second jaw rotates relative to the rail to contact and bend the second leg of the clip toward the base section of the clip.

In another embodiment, the first arm has a length less than a length of the second arm, so that when the actuator moves the connector, the first jaw contacts and bends the first leg of the clip toward the base section of the clip before the second jaw contacts and bends the second leg of the clip toward the base section of the clip.

In other embodiments, the clip closure system is part of a clipper, a bagger, or a netter.

BRIEF DESCRIPTION OF THE SEVERAL VIEWS OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT OF THE INVENTION

Figure 1:
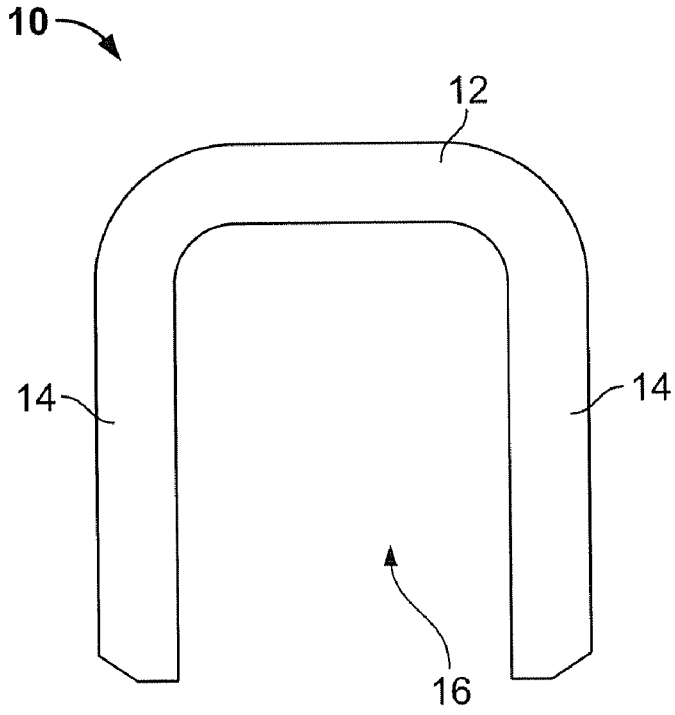
FIG. 1 (Prior Art)
FIG. 1 is a view of a clip as known in the prior art.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
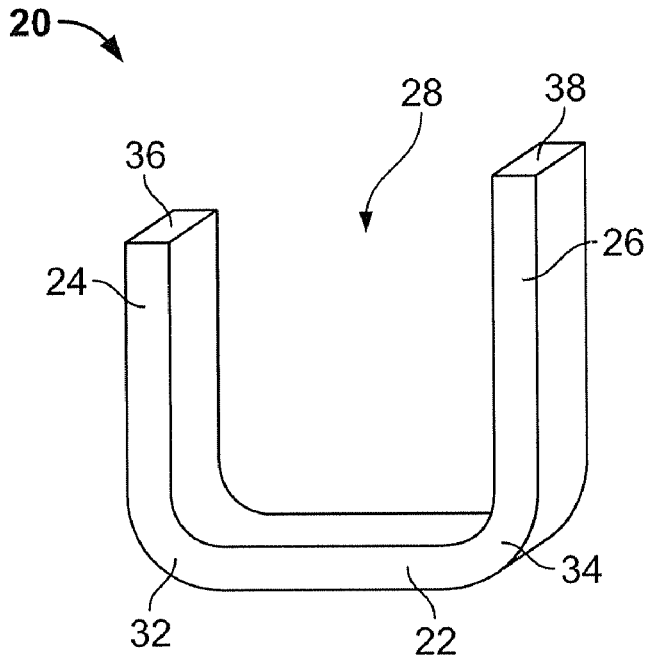
FIG. 2 is a perspective view of a clip of the preferred embodiment of the present invention.

The clip 20 of the preferred embodiment of the present invention is shown in FIG. 2. Clip 20 comprises a base section 22 joining two legs 24, 26. Leg 24 is preferably shorter than leg 26. In the preferred embodiment, leg 26 is approximately the same length as the width of base section 22 and leg 24 is about eighty-five percent (85%) of the length of leg 26.

Base section 22 and legs 24, 26 define a space 28. Clip 20 is preferably made of aluminum or other relatively soft metal. Clip 20 is preferably rectangular in cross-section and preferably of constant cross-sectional area. Clip 20, however, could be round, square, hexagonal, or other shape in cross section and legs 24, 26 could taper from where they meet base section 22 at nodes 32, 34 to their ends 36, 38, respectively.

A plurality of clips 20 can be assembled into a cartridge (not shown) by aligning the clips 20 and applying glue or tape (not shown) in a manner well known in the art. The cartridge can be loaded and configured to deliver clips 20 to the clip closure system of the present invention in a manner well known in the art.

The clip closing system 50 of the preferred embodiment of the present invention is shown in plan view in FIGS. 3 through 6. Clip 20, as shown, is already in place on guide rail 52, which has a first side 54 and a second side 56, with clip 20 held therebetween. Guide rail 52 is a standard guide rail used for clippers as is well known in the art.

First jaw 60 is rotatably mounted to first side 54 by axle 62, so that first jaw 60 rotates in the plane formed by clip 20. First jaw 60 is made of base section 64 and arcuate aim 66. The arc 68 formed by arcuate aim 66 is preferably configured to correspond to the arc 70 that will be formed when leg 24 of clip 20 is bent, as will later be described.

Second jaw 80 is rotatably mounted to second side 56 by axle 82, so that second jaw 80 rotates in the plane formed by clip 20. Second jaw 80 is made of base section 84 and arcuate arm 86. The arc 88 formed by arcuate arm 86 is preferably configured to correspond to the arc 90 that will be formed when leg 26 of clip 20 is bent, as will later be described.

The two base sections 64, 84 are connected through crank arms 100, 110. Crank arm 100 has a first end 104 and a second end 106. First end 104 connects through bearing 108 to a journal on base section 64. Crank arm 110 has a first end 114 and a second end 116. First end connects through bearing 118 to a journal on base section 84. Both second ends 106, 116 connect at connector 120. Connector 120 preferably attaches to an actuator, such as reciprocating cylinder 122, which is preferably an air-actuated cylinder, which operates to move connector 120 in a reciprocal motion, toward guide rail 52 and away from guide rail 52. (For convenience, cylinder 122 is shown only in FIG. 6.) Other means of moving connector 120 in a reciprocal motion are satisfactory, such as a bell crank or cam, which can be operated by a motor or manually by an operator. Whether operated by a motor or by an air supply, the movement of connector 120 can be controlled by the same controller that controls the system to which clip closing system 50 is integrated, as hereinafter explained.

Figure 3:
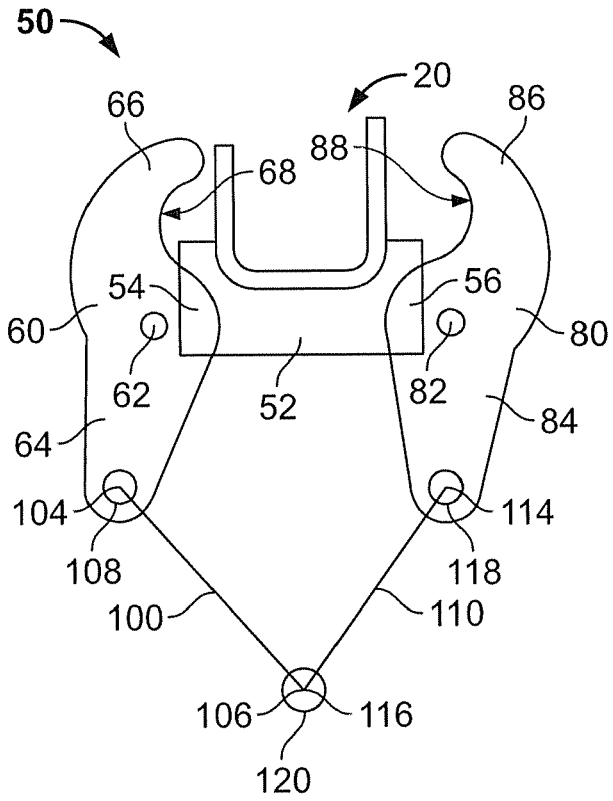
FIG. 3 is a plan view of the preferred embodiment of the clip closure system of the present invention, illustrated in an open position.
Figure 4:
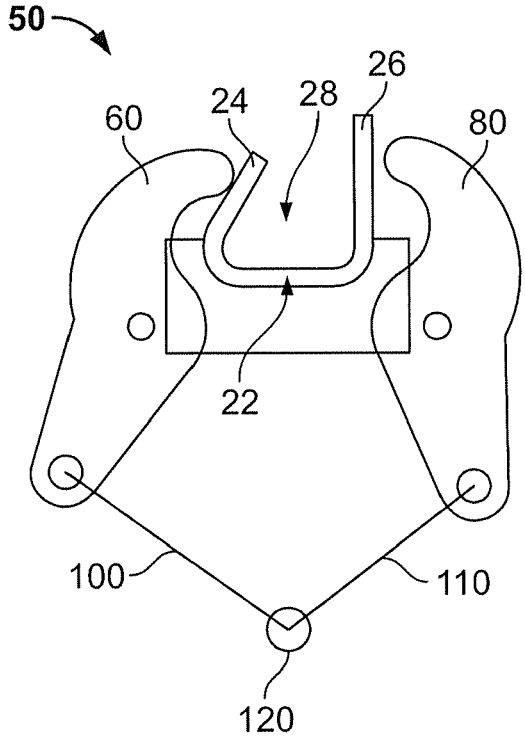
FIG. 4 is a plan view of the preferred embodiment of the clip closure system of the present invention, illustrated with the first jaw beginning to rotate inward.
Figure 5:
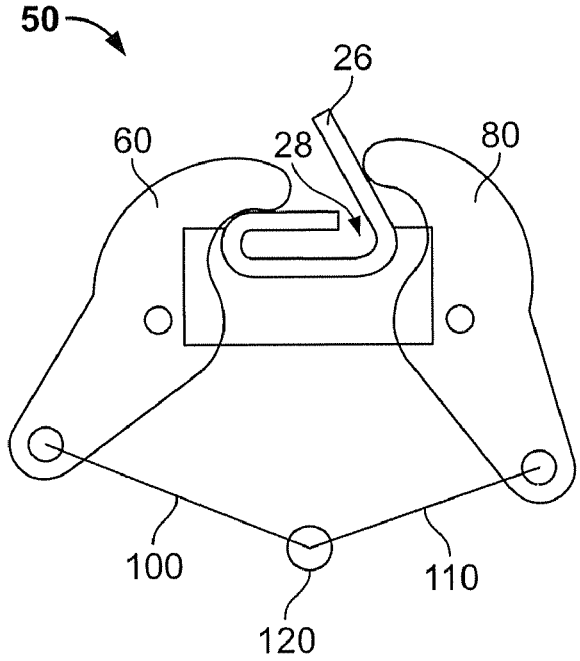
FIG. 5 is a plan view of the preferred embodiment of the clip closure system of the present invention, illustrated with the first jaw completely rotated inward and the second jaw beginning to rotate inward.

Crank arm 100 is preferably shorter than crank arm 110. In the preferred embodiment, crank arm 100 is about 85 percent of the length of crank arm 110. Accordingly, when connector 120 moves toward guide rail 52, as shown in FIGS. 3 and 4, first jaw 60 begins to rotate about axle 62, so that arcuate arm 66 moves toward leg 24 of clip 20. As arcuate arm 66 contacts leg 24, as shown in FIG. 4, leg 24 begins to bend inward into space 28. Further motion of connector 120 toward guide rail 52 causes leg 24 to continue to bend until it is completely bent into its desired position, preferably ninety degrees, as shown in FIG. 5, such that leg 24 is parallel to base section 22. Leg 24 will form a bend defining arc 70, which generally corresponds in shape to arc 68.

Second jaw 80 rotates about axle 82, so that it moves inward toward leg 26 of clip 20. Because crank arm 110 is longer than crank arm 100, second jaw 80 does not rotate inward as quickly as first jaw 60. Accordingly, when first jaw 60 is bending leg 24 inward, second jaw 80 has not yet contacted leg 26, as shown in FIG. 4.

Figure 6:
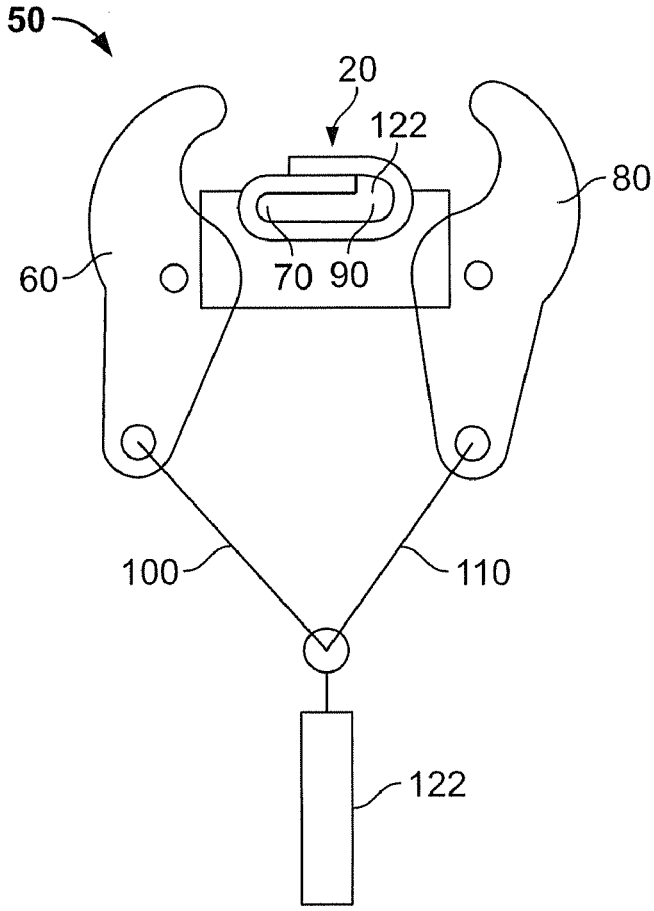
FIG. 6 is a plan view of the preferred embodiment of the clip closure system of the present invention, illustrated with the clip closed and the jaws rotated outward.

Upon further movement of connector 120, second jaw 80 begins to rotate inward, contacts leg 26, and begins to bend leg 26 inward into space 28, as shown in FIG. 5. Further movement of connector 120 causes second jaw 80 to continue to rotate inward, pressing leg 26 further until is has been bent into its desired second position, preferably ninety degrees (90°), as shown in FIG. 6, such that leg 26 is parallel to base section 22. Leg 26 will form a bend defining arc 90, which generally corresponds in shape to arc 88. Since leg 24 has already been bent into its desired position, leg 26 bends against leg 24 and preferably on top of leg 24 such that legs 24, 26 are parallel to one another, as illustrated in FIG. 6, closing clip 20 to form aperture 122. The neck of netting, bag, or casing over which clip 20 had been placed therefore becomes sealed.

Cylinder 122 then actuates to move connector 120 away from rail 52, pulling first jaw 60 and second jaw 80 away from clip 22, as shown in FIG. 6. The material that was clipped, whether it be a netting, bag, or casing which covers a chicken, a sausage, a turkey, or a non-food item, is removed, along with now-closed clip 20, in a manner known in the art and dependent on the apparatus to which clip closure system 50 is integrated, and the process can repeat by placement of a new clip 22 on rail 52.

In one embodiment, clip closure system 50 can be part of a stand-alone, manually operated clipper, such as a SCH 7210, sold by Poly-clip System Corp. In another embodiment, clip closure system 50 is part of an automatic sealing/clipping machine such as a TSCA 120, sold by Poly-clip System Corp. In yet another embodiment, clip closure system 50 can be part of an bagging apparatus, such as is described in U.S. Pat. No. 6,895,726, Poly-Stretch Bagger System, the disclosure of which is incorporated herein by reference. In yet another embodiment, clip closure system 50 can be part of a netting apparatus, such as is described in U.S. Pat. No. 6,883,297, Automated Netter, the disclosure of which is incorporated herein by reference.

While a preferred embodiment of the present invention is shown and described, it is envisioned that those skilled in the art may devise various modifications of the present invention without departing from the spirit and scope of the claims.

I claim:

1. A clip closure system for closing a clip, the clip having a base section and first and second legs extending from opposite ends thereof, said clip closure system comprising:

a rail configured to hold the base section of the clips;

a first jaw mounted on an axle at a first side of said rail and rotatable relative to said rail;

a second jaw mounted on an axle at a second side of said rail and rotatable relative to said rail;

each said jaw comprising an arcuate arm extending in a first direction from said axle toward a leg of the clip and a jaw base section extending in a second direction from said axle away from a leg of the clip, each said axle being located between said arcuate arm and said jaw base section; and said clip closure system further consisting of:

a single actuator;

a connector mounted to said actuator, said actuator movable in a reciprocal motion toward said rail and away from said rail;

a first crank arm connecting said connector to said base section of said first jaw at a first crank arm bearing, said first crank arm having a length from said connector to said first crank arm bearing;

a second crank arm connecting said connector to said base section of said second jaw at a second crank arm bearing, said second crank arm having a length from said connector to said second crank arm bearing, said length of said second arm being less than said length of said first arm.

2. A clip closure system as defined in claim 1, wherein said actuator moves said connector in a reciprocating manner such that said connector moves between a first position near said rail and a second position remote from said rail, when said connector is moved to said first position, said connector causes said first and second jaws to bend the first and second legs of the clip, respectively, when said connector is moved to said second position, said connector causes said first and second jaws to move away from the clip having bent first and second legs.

3. A clip closure system as defined in claim 1, wherein said length of said second arm is approximately eighty-five (85) percent of said length of said first arm.

4. A clip closure system as defined in claim 2, wherein said first jaw contacts and bends the first leg of the clip such that the first leg is generally parallel to the base section of the clip, and wherein said second jaw contacts and bends the second leg of the clip such that the second leg is generally parallel to the first leg and the base section of the clip and such that the second leg of the clip contacts the first leg of the clip, thus closing the clip.

5. A clip closure system as defined in claim 1, wherein said actuator is operated automatically.

6. A clip closure system as defined in claim 5, wherein said actuator is an air-actuated cylinder.

7. A clip closure system as defined in claim 1, wherein said actuator is operated manually.

8. A clip closure system as defined in claim 1, wherein said clip closure system further comprises at least one of a clipping apparatus, a bagging apparatus, and a netting apparatus.

* * * * *